US007755450B2

(12) United States Patent
Tascone et al.

(10) Patent No.: US 7,755,450 B2
(45) Date of Patent: Jul. 13, 2010

(54) WAVEGUIDE CORRELATION UNIT AND A METHOD FOR ITS MANUFACTURING

(75) Inventors: Riccardo Tascone, Turin (IT); Massimo Baralis, Villarbasse (IT); Giuseppe Virone, Castelnuovo Don Bosco (IT); Oscar Antonio Peverini, Buttigliera Alta (IT); Augusto Olivieri, Pianezza (IT)

(73) Assignee: Sisvel Technology SRL, None (TO) (IT)

( * ) Notice: Subject to any disclaimer, the term of this patent is extended or adjusted under 35 U.S.C. 154(b) by 203 days.

(21) Appl. No.: 12/066,220

(22) PCT Filed: Sep. 8, 2006

(86) PCT No.: PCT/EP2006/008787

§ 371 (c)(1),
(2), (4) Date: Jul. 17, 2008

(87) PCT Pub. No.: WO2007/028637

PCT Pub. Date: Mar. 15, 2007

(65) Prior Publication Data

US 2008/0315969 A1 Dec. 25, 2008

(30) Foreign Application Priority Data

Sep. 8, 2005 (EP) ..... 05019553

(51) Int. Cl.
*H01P 3/12* (2006.01)
*H01P 1/213* (2006.01)

(52) U.S. Cl. ..... 333/113; 333/135; 333/210

(58) Field of Classification Search ..... 333/109, 333/113, 115, 117, 118, 132, 135, 208, 210, 333/212, 239, 248
See application file for complete search history.

(56) References Cited

U.S. PATENT DOCUMENTS 5,155,456 A 10/1992 Ruff et al.

(Continued)

FOREIGN PATENT DOCUMENTS

EP 0 322 739 A1 7/1989

OTHER PUBLICATIONS

Virone-Giuseppe et al., Five-Level Waveguide Correlation Unit for Astrophysical Polarimetric Measurements, Feb. 2007, IEEE Transactions on Microwave Theory and Techniques, vol. 55 No. 2, 9 pages.*

(Continued)

*Primary Examiner*—Dean O Takaoka
(74) *Attorney, Agent, or Firm*—Workman Nydegger

(57) ABSTRACT

A waveguide correlation unit and a method for manufacturing the same are disclosed. The waveguide correlation unit includes stacked first and second waveguide plates having an identical configuration, wherein a central coupling plate is disposed therebetween. Due to the identical configuration of the first and second waveguide plates, mechanical uncertainties may significantly be reduced, since both plates may be formed in a common process without the repositioning activities during the manufacturing process.

21 Claims, 7 Drawing Sheets

U.S. PATENT DOCUMENTS

| | | | | |
|---|---|---|---|---|
| 6,573,808 | B1 * | 6/2003 | Burin | 333/132 |
| 6,710,678 | B2 * | 3/2004 | Thormar | 333/135 |
| 6,876,277 | B2 * | 4/2005 | Cooper | 333/208 |

OTHER PUBLICATIONS

Andrew Fort et al., *A Performance and Complexity Comparison of Auto-Correlation and Cross-Correlation for OFDM Burst Synchronization*, 2003 IEEE International Conference on Acoustics, Speech, and Signal Processing, Apr. 6, 2003 pp. II-341-II-344.

Y.T. Chan et al., *Approximate Maximum-Likelihood Delay Estimation Via Orthogonal Wavelet Transform*, 1997 IEEE International Symposium on Circuits and Systems, Jun. 9-12, 1997, pp. 2501-2504.

* cited by examiner

WAVEGUIDE CORRELATION UNIT AND A METHOD FOR ITS MANUFACTURING

FIELD OF THE PRESENT INVENTION

The present invention generally relates to processing of high frequency signals, such as microwaves, and more particularly relates to correlating two input signals with high precision.

PRESENT STATE OF THE ART

In many fields of technology and research frequently the correlation between two high frequency signals is required, wherein the signal to noise ratio may be very small. Although typical signal processing techniques, including the quantization of input signals and the subsequent processing by means of appropriate algorithms, may be applied for determining the correlation between two input signals, a high level of accuracy for a bandwidth in the range of millimeter wavelengths may be very difficult to achieve due to the large amount of data that may have to be processed and the quantization errors involved. Therefore, in applications requiring the investigation of the polarization state, in particular of microwaves, the scattering wave from a body or scenery, or any other applications of polarimetry, an analogue processing of the high frequency signals may be advantageous, especially when a real time detection is required. An illustrative example of determining the correlation between two input signals may be the measurement and determination of the polarization of the cosmic microwave background radiation, which may bring valuable information with respect to the early states of the universe. However, although extremely important, the cosmic microwave background polarization is rather weak and thus the measurement thereof requires highly accurate polarimeters both in the microwave and millimeter wave regime. Thus, the extremely weak cosmic microwave background polarization signal requires instruments that are configured to reduce systematic and spurious signals in addition to high measurement stability so as to allow long integration times and good instantaneous sensitivities. For example, the balloon borne radiometers for sky polarization observations is an experiment designed to measure the linearly polarized emission of the cosmic microwave background. The design of this experiment is based on the radiopolarimeters in the 30-90 GHz range and is optimized to reduce systematic effects and to have a high purity in the Q and U Stokes parameter measurements. In this experiment, the two circular polarizations that are collected by a feed horn are extracted by a polarizer and an ortho-mode transducer (OMT). After the amplification performed by HEMT the resulting signals are correlated by a correlation unit so as to simultaneously obtain the Q and U parameter, which are given by the real and imaginary part of the product between the right handed polarized electric field vector and the complex conjugate of the left handed polarized electric field vector. In order to obtain the required accuracy for providing the Q and U parameters even for the extremely low signal-to-noise ratio in the case of measuring the polarized fraction of the cosmic microwave background radiation, a correlation unit is required that operates at high frequencies without frequency conversion and that simultaneously provides the magnitude and phase of the products AB* without unduly introducing an unwanted component of the non-polarized radiation into the Q and U parameter values.

SUMMARY OF THE INVENTION

It is therefore an object of the present invention to provide a technique that enables the determination of the magnitude and phase of the product AB* of two high frequency input signals A and B, while avoiding one or more of the problems identified above or at least reduce the effects thereof.

According to one aspect of the present invention, the object is solved by a waveguide correlation unit comprising a first waveguide plate comprising a first input coupler for receiving a first signal and further comprising a plurality of first output couplers. Moreover, the waveguide correlation unit further comprises a second waveguide plate comprising a second input coupler for receiving a second signal and further comprising a plurality of second output couplers, wherein the first and the second waveguide plates have the same layout configuration. Moreover, a central coupling layer is disposed between the first and the second waveguide plates so as to form a stacked structure with the first waveguide plate and the second waveguide plate.

Thus, as specified above, the inventive waveguide correlation unit is configured as a stack of two waveguide plates with an intermediate central coupling layer, wherein the two waveguide plates have an identical layout configuration, thereby providing a high degree of symmetry which may be highly advantageous in manufacturing the waveguide plates and the signal processing so as to significantly reduce, due to the high degree of "common mode rejection", any "contamination" that may be introduced into the output signals obtained from the first and second signals after passing through the waveguide correlation unit.

In a further advantageous embodiment, the first and second waveguide plates comprise first and second waveguide filters, respectively, wherein the first waveguide filter is coupled to the first input coupler and the second waveguide filter is coupled to the second input coupler.

Consequently, in addition to being configured for correlating the two input signals, the first and second waveguide filters may provide the possibility to precisely define the measuring band by effectively rejecting any signals within the stop band defined by the waveguide filters. Hence, the efficiency of the actual correlation process may significantly be enhanced.

In a further preferred embodiment, the waveguide correlation unit further comprises a first directional coupler and a second directional coupler, wherein the first and the second directional couplers are coupled to one of the second and first output couplers, respectively, and are further configured to provide first and second monitor signals that are indicative for the first and second signals.

Hence, the signal levels for the first and second signals may be monitored, for instance by providing an appropriate detector device, such as diodes having a quadratic characteristic, while the remaining part of the first and second signals may be processed by the correlation unit without undue interaction with the respective monitor signals.

In a further advantageous embodiment, the waveguide correlation unit further comprises a first hybrid coupler configured to receive a portion of the first signal and a second hybrid coupler configured to receive a portion of the second signal, wherein the first and second hybrid couplers each provide a first and a second part of the portions of the first and second signals, respectively, for further processing in the correlation unit. For example, the first and second hybrid couplers may receive those portions of the first and second signals, which are obtained after the separation of the respective monitor signals. Due to the provision of directional couplers provided as hybrid couplers, instead of, for instance, power splitters as are frequently encountered in conventional waveguide devices, a high level of decoupling between the two branches output by each of the first and second hybrid couplers is accomplished. Consequently, due to the reduced crosstalk between the respective branches of each hybrid coupler, which then undergo a further combination so as to provide the desired combinations of the first and second signals, a significantly reduced interference between the individual branches is obtained.

According to still a further advantageous embodiment, the waveguide correlation unit further comprises a third hybrid coupler configured to receive the first parts of the portions of the first and second signals. Moreover, a phase shifter is provided and is configured to receive the second part of the portion of the second signal and a fourth hybrid coupler is provided and is configured to receive the phase shifted second part and the non-phase shifted second part of the portion of the first signal.

Consequently, the required combinations of the first and second signals are achieved by means of the third and fourth hybrid couplers wherein the additional phase shifter, when designed as a 90 degree phase shifter, results in the desired combination of the sum and the difference of the first and second signals, as well as the sum and the difference of the first signal and the 90 degree phase shifted second signal. Thus, the corresponding output signals may then be supplied to quadratic characteristic diodes and subsequently amplified by means of two differential amplifiers, thereby yielding the real and imaginary parts of the average of the desired correlation product of the first and second signals.

In a further preferred embodiment, the first waveguide plate is identical to the second waveguide plate apart from a spatial 180 degree rotation. Consequently, the first and second waveguide plates may be realized simultaneously with a high mechanical precision technique thereby guaranteeing a high rejection to any outer correlation terms even for very high frequencies.

In a further advantageous embodiment, each of a plurality of waveguide sections in the first and second waveguide plates comprises a rectangular cross-section. Thus, due to the simple geometric configuration of the waveguide sections forming the various circuit components, the overall layout may be kept simple and thus efficient with respect to manufacturing the waveguide plates, thereby even more enhancing the mechanical precision of the finally obtained waveguide correlation unit.

In a further embodiment, the waveguide sections are arranged in a plurality of levels within the E-plane that is defined by the first and second waveguide plates.

Hence, by arranging the various circuit elements of the waveguide correlation unit within each waveguide plate in a plurality of "stacked" levels, a very compact overall design of the unit may be achieved, thereby allowing a wide variety of applications.

In one illustrative embodiment, the waveguide sections are arranged in five levels. In this way, a highly compact device may be provided, which may have dimensions of 257 mm×82 mm×21 mm for a unit operating in the Ka band (32 GHz).

In a further preferred embodiment, the waveguide correlation unit further comprises a first cover plate attached to the first waveguide plate and a second cover plate attached to the second waveguide plate, wherein the first cover plate has formed thereon flanges connected to the first input coupler and the plurality of first output couplers and wherein the second cover plate has formed thereon flanges connected to the second input coupler and the plurality of second output couplers.

Due to the provision of the cover plates, the outer walls of the respective waveguide components may be provided, while at the same time standard functional elements, such as waveguide couplers and the like, may be provided so that a high degree of compatibility to standard devices with respect to connectivity is maintained. Additionally, enhanced compactness of the device is achieved and efficient manufacturing procedures may be applied for forming the inventive waveguide correlation unit.

In a further advantageous embodiment, the waveguide correlation unit further comprises a plurality of through-holes extending at least through the first and second waveguide plates and the central coupling layer for fixing a relative position of the first and second waveguide plates and the central coupling unit with respect to each other.

By means of the plurality of through-holes the contact pressure between stacked waveguide plates and the central coupling layer is guaranteed to be uniform, thereby ensuring a high mechanical precision so as to provide for the required rejection of common mode signals or auto correlation terms.

In a further embodiment, the plurality of through-holes is arranged in each of the first and second waveguide plates in a symmetric manner with respect to a symmetry axis defined in each of the first and second waveguide plates.

The symmetric configuration of the through-holes allows the assembly process after a 180 degree rotation of a waveguide plate with respect to the other one. For instance, it is highly advantageous to define the symmetry axis parallel to an axis of rotation for the 180 degree rotation so as to align the waveguide plates to each other in order to form the final waveguide stack. In this way, the through-holes symmetrically arranged with respect to the axis of rotation may be manufactured simultaneously in a common manufacturing process.

In a further preferred embodiment, each of the waveguide filters is comprised of a cascade of E-plane discontinuities. Consequently, a high degree of stop band rejection may be achieved by a simple geometric configuration of the waveguide filters, thereby significantly contributing to the overall mechanical precision of the individual waveguide components as, for instance, the cascaded discontinuities may be designed so as to have the same geometric configuration, such as rectangular cavities.

In one illustrative embodiment, each of the first and the second directional couplers comprises a matched load integrally formed with the first and the second waveguide plates. With this configuration, the directional couplers may be designed to branch off a desired part of the respective signals while nevertheless providing a compact design in that the corresponding load material is integrated into the respective waveguide plates.

In a further illustrative embodiment, the first and second hybrid couplers each comprise a matched load integrally formed with the first and second waveguide plates.

As pointed out with respect to the first and the second directional couplers, also in this case an efficient and compact design may be obtained by integrating the load material into the respective waveguide plates.

In a further embodiment the waveguide correlation unit is configured to process the first and second signals having a centre wavelength ranging from 3-15 mm. Consequently, the inventive waveguide correlation unit may advantageously be applied to a wide variety of applications, since the respective waveguide sections or components may readily be adapted to any appropriate microwave band. Hence, an overall compact design in combination with a high precision achieved by the reduction of any mechanical uncertainties due to the symmetric configuration of the waveguide plates results in the required high common mode rejection.

According to another aspect of the present invention, a waveguide correlation device comprises a first waveguide correlation unit according to any of the embodiments described above, wherein the first waveguide correlation unit is configured to process a first centre wavelength. Moreover, the waveguide correlation device comprises a second waveguide correlation unit according to any of the above-described embodiments, which is configured to process a second centre wavelength. Hereby, the first waveguide plates of the first and second waveguide correlation units are integrally formed and also the second waveguide plates of the first and second waveguide correlation units are integrally formed.

Consequently, with this configuration, a highly precise and compact waveguide correlation device may be provided, which enables the processing of a plurality of signals, which may have the same centre wavelengths or which may have different centre wavelengths. Since the various waveguide plates are integrally formed a high precision with respect to mechanical uncertainties may be achieved, while in principle the same manufacturing procedure may be applied for the various waveguide components irrespective of the number of signals of equal or different wavelengths that have to be handled by the waveguide components.

In accordance with yet another aspect of the present invention, a method of manufacturing a first and a second waveguide plate to be stacked for forming a waveguide correlation unit is provided. The method comprises designing an identical layout for a waveguide pattern of the waveguide correlation unit for each of the first and the second waveguide plates. Moreover, a first piece of waveguide material is fixedly positioned relative to a second piece of waveguide material and then the waveguide pattern is simultaneously transferred into the first and second pieces forming the first and second waveguide plates. Moreover, the first and second waveguide plates are aligned with respect to each other after releasing them from the fixed position so as to form a stack defining in combination the components of the waveguide correlation unit. Finally, the aligned stack is fixed.

As previously pointed out, a high degree of mechanical precision and symmetry of the waveguide components is required so as to provide for the high rejection of common mode signals, such as the unpolarized fraction of the cosmic microwave background radiation, in order to enable a precise determination of the product of the real and imaginary parts of the input signals. Due to the identical layout of the corresponding waveguide patterns of the first and second waveguide plates, a common manufacturing process may be applied without any intermediate position change of the waveguide plates, thereby significantly contributing to enhancing the "overlay" accuracy and thus mechanical precision of the finally obtained stacked structure. For example, the corresponding pieces of waveguide material may be stacked and may then be patterned in a common process, for instance by a wire electric discharge machine so that at least components of the waveguide correlation unit that are provided for processing each of a first and a second signal have substantially identical shapes and dimensions, thereby significantly reducing any non-symmetric effects during the analogue signal processing within the waveguide correlation unit.

In a further preferred embodiment, the method further comprises forming a pattern of through-holes while transferring the waveguide pattern into the first and second pieces, wherein the pattern of through-holes is symmetric in each of the first and second waveguide plates with respect to a corresponding axis defined in each of the first and second waveguide plates.

The symmetric configuration of the through-holes allows the 180 degree rotation of the second waveguide plates for forming the stacked configuration. In other words, the axis of symmetry of the arrangement of the through-holes is selected such that it substantially corresponds to an axis of rotation so as to transfer the first and second waveguide plates from the fixed position into the aligned stack position. Thus, the two waveguide plates can be simultaneously manufactured maintaining a high level of symmetry even within the mechanical manufacturing errors.

In a further advantageous embodiment, the method further comprises fixedly positioning a central coupling plate for the waveguide correlation unit with respect to the first and second waveguide plates and commonly forming a plurality of through-holes in the first and second waveguide plates and in the central coupling plate.

Due to the symmetrical configuration of the pattern of through-holes with respect to an axis of rotation used for bringing the waveguide plates from the fixed position into the aligned or stacked position the through-holes may also commonly be formed in the central coupling plate, thereby significantly contributing to the overall mechanical accuracy of the finally stacked structure.

In accordance with a further advantageous embodiment, the method further comprises fixedly positioning the first and the second cover plates with respect to the first and second waveguide plates and commonly forming the through-holes in the first and second waveguide plates and the first and second cover plates.

Consequently, a high degree of mechanical precision may be maintained throughout the whole manufacturing process, since also the cover plates, which may form outer walls of the respective waveguide components, may receive the corresponding through-holes in a common manufacturing process, wherein advantageously the waveguide plates may not be moved during the entire patterning sequence for forming the waveguide patterns and the pattern of through-holes.

BRIEF DESCRIPTION OF THE DRAWINGS

Further advantageous embodiments of the present invention are described in the appended claims and in the following detailed description, in which reference is made to the accompanying drawings, in which:

DETAILED DESCRIPTION OF THE PREFERRED EMBODIMENTS

As previously explained, for a fast and precise measurement of the correlation of two input signals, for instance with respect to their polarization state, it is highly advantageous to simultaneously measure the Q and U Stokes parameters of a polarized radiation on the basis of input signals, which will be referred to as signal A and signal B and which may represent the two circularly polarized outputs of an antenna. In this case, the real and imaginary parts of the average product AB* correspond to the respective Q and U parameters according to the following formula.

$$Q=\langle |A+B|^2-|A-B|^2\rangle=4\langle \Re\{AB^*\}\rangle$$

$$U=\langle |A+jB|^2-|A-jB|^2\rangle=4\langle \Im\{AB^*\}\rangle \quad (1)$$

In equation (1) the quantities $|A|^2$ and $|B|^2$ are eliminated by cancellation. Moreover, the level of these two quantities is substantially defined by the non-polarized component, which is significantly greater than the polarized component. Consequently, the correlation unit according to the present invention is designed to have a very high rejection for the common mode signals, i.e. the auto correlation terms. This is accomplished by providing a waveguide structure having significantly reduced mechanical uncertainties, thereby ensuring a high rejection to the auto correlation terms even for wavelengths in the range of 3 mm.

With reference to FIGS. 1*a*-1*h* and FIG. 2, further illustrative embodiments of the present invention will now be described in more detail.

Figure 1A:
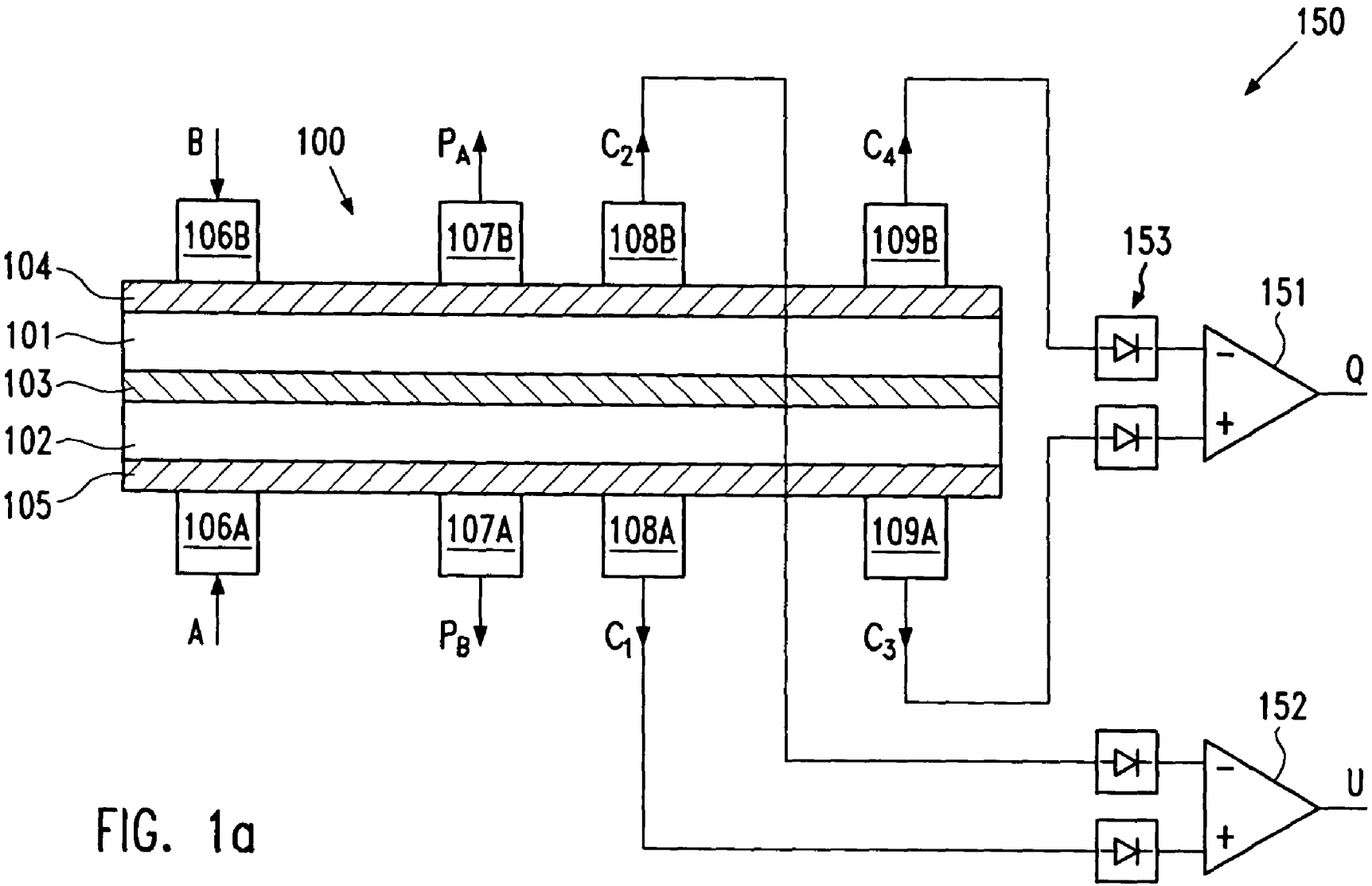
FIG. 1*a* schematically shows a system for providing the Q and U Stokes parameter on the basis of two input signals by using a waveguide correlation unit according to the present invention.

FIG. 1*a* schematically shows a system 150 comprising a waveguide correlation unit 100, which in turn comprises a first waveguide plate 102 and a second waveguide plate 101 in which are formed corresponding waveguide sections or components, which are not shown in FIG. 1*a* and which will be described in more detail later on with respect to FIGS. 1*c*-1*g*. The first and second waveguide plates 102 and 101 are arranged in a stacked configuration, wherein a central coupling plate 103 is disposed in between and comprises corresponding openings so as to allow signal coupling between the first and the second waveguide plates 102 and 101. Moreover, a first cover plate 105 attached to the first waveguide plate 102 and a second cover plate 104 attached to the second waveguide plate 101 are provided to act as outer walls of the corresponding waveguide plates 101 and 102, and also allow the provision of corresponding input coupling portions 106*a* and 106*b* for receiving a first signal A and a second signal B. The coupling portions 106*a*, 106*b* may be provided in the form of standard waveguide connectors so as to enable the connection to any standard waveguide lengths for providing the first and the second signals A and B. Further, the first cover plate 105 may have formed thereon a plurality of output coupling portions 107*a*, 108*a*, 109*a*, while the second cover plate 104 may similarly comprise corresponding output coupling portions 107*b*, 108*b* and 109*b*. For example, standard rectangular waveguides may be used for the coupling portions 106*a*, . . . , 109*a* and 106*b*, . . . , 109*b* such as WR42 for the K band (22 GHz), WR28 for the Ka band (32 GHz), WR15 for the Q band (60 GHz), and WR10 for the W band (90 GHz). In the embodiment shown, the first and second signals A, B may represent output signals from a preceding stage, such as an antenna (not shown) with double circular polarization and a subsequent polarizer and OMT device so that the waveguide correlation unit 100 may provide respective output signals A+iB and A−iB at the corresponding output coupling portions 108*a*, 108*b*, wherein these signals are also referred to as C1 and C2, respectively. Similarly, respective output signals A+B and A−B may be provided at the output coupling portions 109*a* and 109*b*, respectively, wherein these signals may also be referred to as C3 and C4. The output coupling portions 107*a* and 107*b* may provide a portion of the input signals B and A, respectively, wherein the corresponding output signals are also referred to as $P_B$ and $P_A$. Consequently, the coupling portions 107*a*, 107*b* enable the monitoring of the corresponding input signals B and A, for instance by providing a detector diode having a quadratic characteristic for each of the signals $P_B$ and $P_A$. Moreover, the correlation system 150 further comprises a first differential amplifier 151 and a second differential amplifier 152, wherein the first differential amplifier 151 is coupled to the output coupling portions 109*a*, 109*b* via corresponding diodes 153 having a quadratic characteristic. Similarly, the second differential amplifier 152 is coupled to the output coupling portions 108*a*, 108*b* via corresponding diodes 154 having a quadratic characteristic. Consequently, the output of the differential amplifier 151 may provide the Q parameter according to equation 1, while the output of the second differential amplifier 152 may provide the U parameter according to equation 1.

Figure 1B:
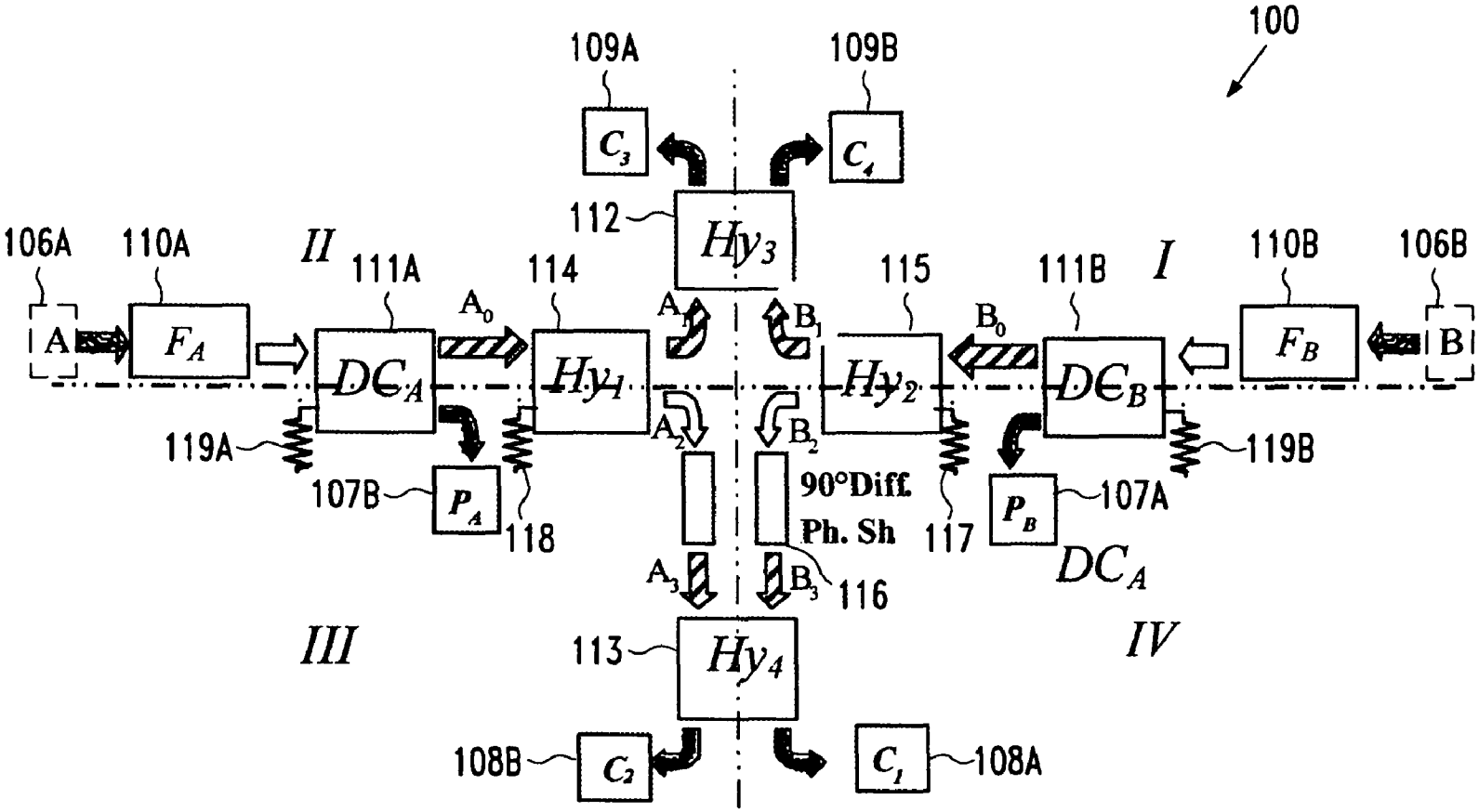
FIG. 1*b* schematically shows a scheme of waveguide components integrated in the waveguide correlation unit to obtain the in-phase and quadrature sums and differences of the two input signals in accordance with an illustrative embodiment of the present invention.

FIG. 1*b* shows a schematic scheme of the waveguide correlation unit 100 as shown in FIG. 1*a* in accordance with one illustrative embodiment of the present invention.

As may be seen, the sum and differences of the respective input signals A and B are obtained by a first and a second directional coupler 114 and 115 in combination with a third and fourth directional coupler 112 and 113 and a phase shifter 116 provided between one output of the second directional coupler 115 and a first input of the fourth directional coupler 113. Furthermore, a first and a second waveguide filter 110*a* and 110*b* may be provided, which are appropriately dimensioned so as to define the operating band of the waveguide correlation unit 100. Moreover, a first and a second power splitter 111*a* and 111*b* in the form of directional couplers may be provided so as to allow the detection of the intensities of the two input signals $P_A$ and $P_B$ at the output coupling portions 107*b* and 107*a*, respectively.

During the operation of the correlation unit, the respective input signals A and B may be provided at the corresponding input coupling portions 106*a* and 106*b*. The corresponding waveguide filters 110*a* and 110*b* receive the input signals, and significantly suppress any unwanted frequency components, thereby providing a high rejection in the stop band so as to precisely define the measuring band, for which the correlation unit 100 is designed. As explained above, depending on the specific application, microwave radiation within a wavelength range of approximately 3-15 mm may advantageously be processed by the unit 100, thereby rendering the unit 100 highly advantageous for sensitive polarization measurements in this specified wavelength arrangement. It should be appreciated, however, that the principles of the present invention may also be applied wavelengths other than those specified above. The filtered signals A, B output by the corresponding waveguide filters 110*a*, 110*b* are supplied to the corresponding directional couplers 111*a*, 111*b*, which are configured to include a corresponding matched load 119*a*, 119*b*, respectively, which is integrated in the corresponding waveguide plates, as will be described in more detail with reference to FIGS. 1*c*-1*e*. The directional couplers 111*a*, 111*b* may be represented as two 9 dB directional couplers so as to branch off the corresponding monitor signals $P_A$ and $P_B$. The monitor signals $P_A$, $P_B$ available at the output coupling portions 107*b* and 107*a*, respectively, may then be detected by respective diodes having a quadratic characteristic such as the diodes 153 and 154 illustrated in FIG. 1*a*. The remaining signal portions, now indicated as $A_0$ and $B_0$, are supplied to the first and second directional couples 114, 115, respectively, and are preferably divided into substantial identical parts. The couplers 114, 115 are in one preferred embodiment provided as two 3 dB directional couplers, that is, hybrid couplers rather than as power splitters, so as to achieve a high level of decoupling between the two signal branches indicated as $A_1$ and $A_2$ for the hybrid coupler 114, and B1 and B2 for the hybrid coupler 115. Also, in this case, the directional couplers 114, 115 have incorporated therein respective matched loads 118 and 117, respectively, which may also be integrally formed with the corresponding waveguide plates, as will be described in more detail later on. The output signals A1, A2 provided by the directional coupler 114 are supplied to a first input of the third and fourth directional couplers, ie. hybrid couplers 112, 113, while similarly the output signals B1, B2 provided by the directional coupler 114 are supplied to the respective second inputs of the couplers 112, 113. Hereby, the signals A2 and B2 are supplied to the hybrid couplers 113, via a phase shifter 116 whereas the output signals A1 and B1 are directly, ie. without phase shifting, provided to the respective inputs of the coupler 112. The coupler 112 may be provided in the form of a 3 dB coupler so as to produce the output signals C3 and C4 that are proportional to A+jB and A−jB, respectively. Similarly, the coupler 113 may be provided as a 3 dB coupler to produce the output signals C1, C2, which are proportional to A+B and A−B, respectively. As previously discussed, a very high rejection of the auto-correlation terms in the input signals A and B is obtained by providing a highly symmetric arrangement of the waveguide correlation unit 100. The symmetric arrangement, i.e. the identical configuration of the waveguide plates 101, 102 (cf. FIG. 1*a*) results in significantly reduced mechanical uncertainties so as to achieve a high symmetric signal "processing" by the individual waveguide components. Moreover, the design of the waveguide correlation unit 100 is established such that the required volume for applications in the "low" frequency range, such as the K band, may readily be realized, while at the same time for high frequency applications the required high mechanical accuracy is guaranteed.

Figure 1C:
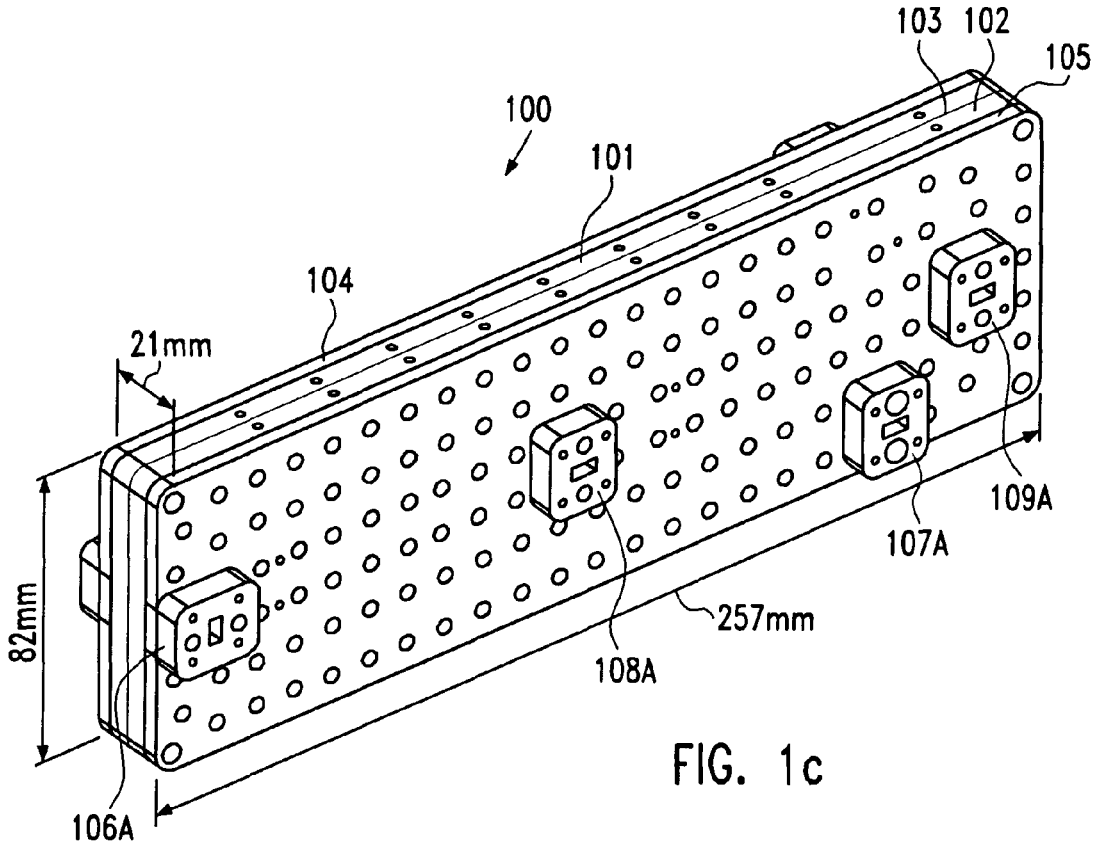
FIGS. 1*c* and 1*d* schematically show a perspective view of the waveguide correlation unit in an assembled state.

FIG. 1*c* schematically shows a perspective view of an exemplary embodiment of the waveguide correlation unit 100 as schematically illustrated in FIG. 1*a* and having the components as illustrated in FIG. 1*b*. The unit 100 is shown from the side that corresponds to the input coupling portion 106*a* for receiving the input signal A. Consequently, the output coupling portions 108*a*, 107*a*, 109*a* are attached to the cover plate 105, which in turn is attached to the first waveguide plate 102. The cross-like configuration as shown in FIG. 1*b*, i.e. comprising the quadrants I, II, III and IV, is realized such that the second quadrant and the fourth quadrant are formed in the first waveguide plate 102 and the corresponding cover plate 105, while the first quadrant and the third quadrant are realized in the second waveguide plate 101 and the corresponding cover plate 104 attached thereto, wherein the central coupling plate 103 is disposed between the first and second waveguide plates 102, 101 and comprises corresponding coupling apertures (not shown in FIG. 1*c*) for providing the required H-plane discontinuities. The waveguide correlation unit 100 as shown in FIG. 1*c* may be designed for operating in the above specified wavelength range and may have in one example operating in the Ka band (32 GHz) the dimensions of 257 mm, 82 mm, and 21 mm for the length, the width and the height, respectively.

Figure 1D:
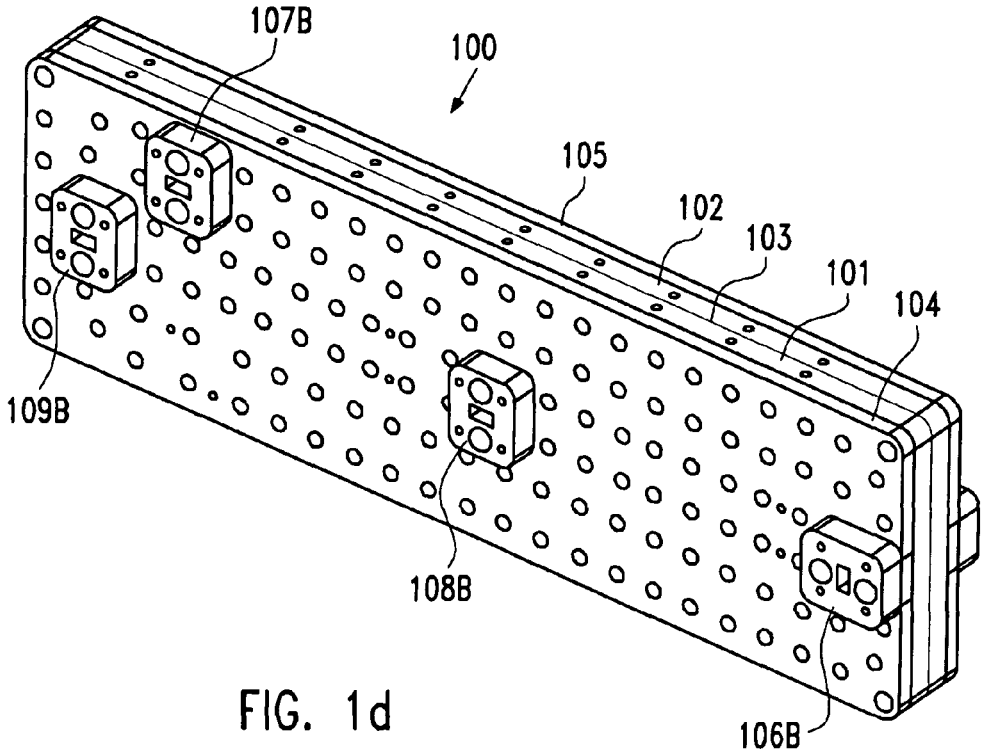

Similarly, FIG. 1*d* schematically shows a perspective view of the waveguide correlation unit 100 from the side corresponding to the input coupling portion 106*b*. Consequently, the corresponding output coupling portions 108*b*, 107*b* and 109*b* may be identified in FIG. 1*d*.

Figure 1E:
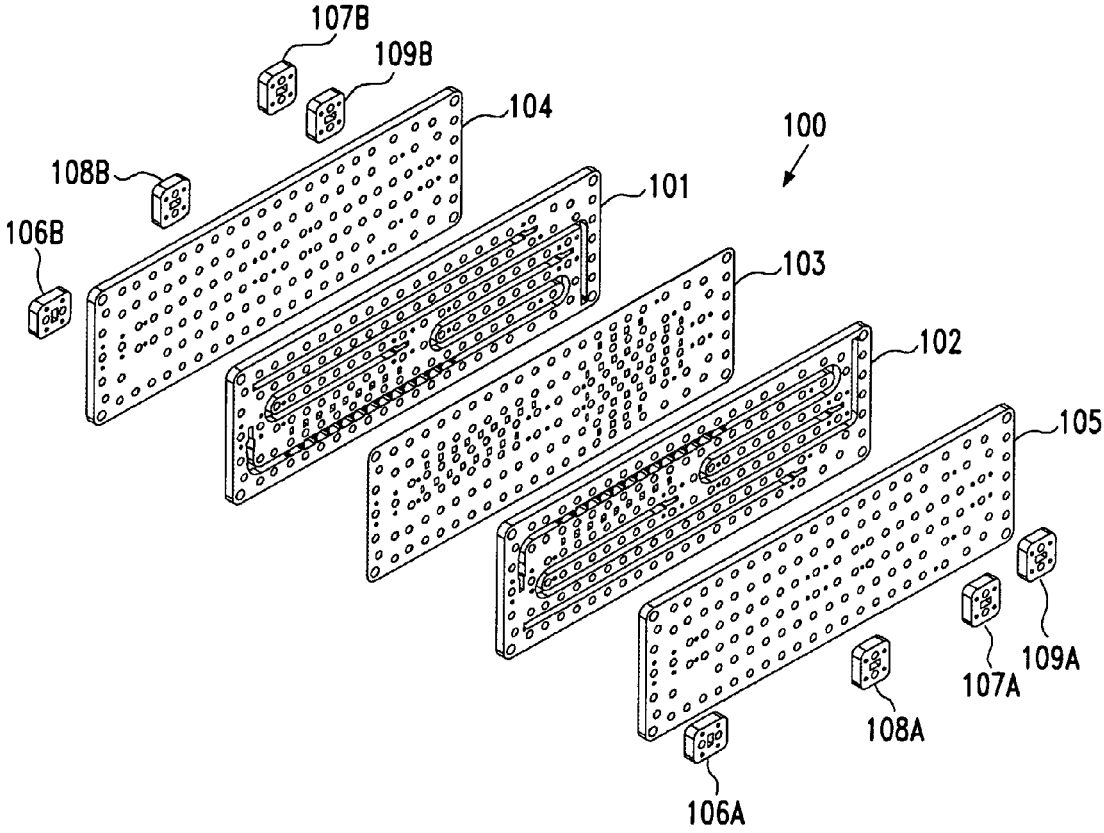
FIG. 1*e* schematically shows a perspective exploded view of the waveguide correlation unit of FIGS. 1*c* and 1*d;*

FIG. 1*e* schematically shows an exploded perspective view of the waveguide correlation unit 100 as shown in FIGS. 1*c* and 1*d*, wherein each of the various plates of the stacked structure is visible. Moreover, the rectangular waveguide sections formed in the first and second waveguide plates 102, 101 are shown wherein the configuration of the plates 102, 101 is identical except for a 180 degree rotation. Moreover, the first and second waveguide plates 102, 101 may have a constant and identical thickness so that both plates 102, 101 may be formed in a highly efficient manner on the basis of appropriate metallic or otherwise conductive sheets of materials. Furthermore, the central coupling plate 103 is visible, which comprises a plurality of rectangular apertures, as will be described in more detail later on, wherein a thickness of the central coupling plate 103 may be selected to approximately 0.1 mm, without requiring a specific adaptation to the above-specified wavelength range.

Figure 1F:
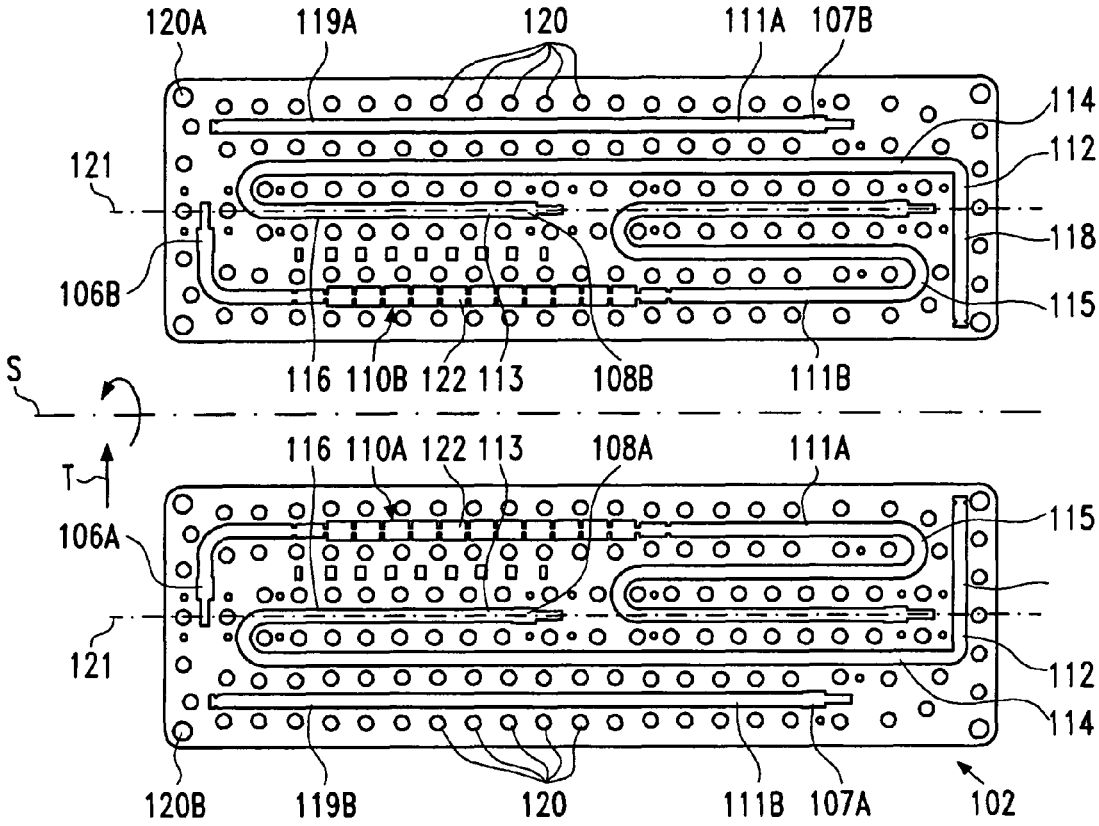
FIG. 1*f* schematically illustrates in a plan view the two waveguide plates having the same configuration according to one illustrative embodiment of the present invention.
Figure 1G:
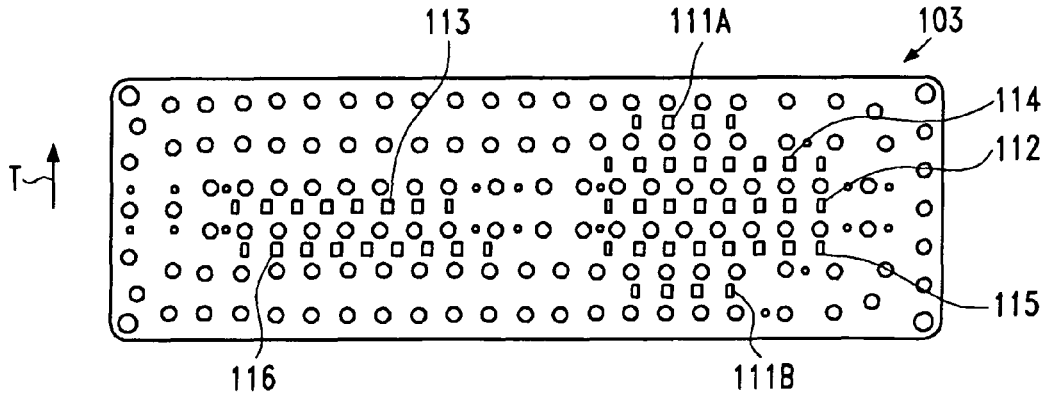
FIG. 1*g* schematically shows a central coupling plate that provides the coupling between the waveguide plates shown in FIG. 1*f;*

With reference to FIGS. 1*f* and 1*g* the waveguide sections and components of the first and second waveguide plates 102, 101 and the central coupling plate 103 will now be described in more detail.

FIG. 1*f* schematically shows a top view of the first and second waveguide plates 102 and 101 for the waveguide correlation unit 100 as shown in FIGS. 1*c*-1*e*. The lower part of FIG. 1*f* illustrates the first waveguide plate 102 having formed therein a plurality of waveguide sections with a rectangular cross-section, while the upper portion of FIG. 1*f* represents the second waveguide plate 101.

At the left hand side of the waveguide plate 102 is formed a rectangular opening that corresponds to the input coupling portion 106*a*. Although not shown in FIG. 1*f*, it is to be appreciated that a corresponding aperture is also formed within the corresponding cover plate 105 attached to the first waveguide plate 102 as may be seen in FIG. 1*c*. In FIG. 1*b*, the corresponding signal path from the input coupling portion 106*a* to the respective rectangular aperture in the plate 102 as shown in FIG. 1*f* is symbolized by a dark arrow, thereby indicating a substantially L-shaped junction so as to connect the input coupling portion 106*a* with the downstream waveguide filter 110*a*. Moreover, in FIG. 1*b* direct signal connections are indicated by white arrows and c-shaped connections are indicated by dashed arrows. The filter 110*a* may be provided in the form of a cascade of rectangular cavities, formed by E-plane discontinuities, wherein in the present example 13 rectangular cavities 122 are provided so as to form the filter 110*a*. The subsequent linear portion of the substantially snake-like waveguide section forms, in combination with corresponding parallel sections in the second waveguide plate 101 and respective rectangular H-plane apertures formed in the central coupling layer 103, the directional coupler 111*a*. For convenience, the coupling apertures in the central coupling plate 103 are denoted with the same reference number as the corresponding waveguide component in the first and second waveguide plates 102.

The matched load 119*a* of the directional coupler 111*a* may be formed integrally in the second waveguide plate 101 and may be made of ECOSORB MF-190 material. By means of a c-shaped connection a further linear waveguide portion in the first waveguide plate 102 represents one part of the hybrid coupler 114, while the other part is represented by the corresponding linear portion of the waveguide section in the second waveguide plate 101 with corresponding H-plane rectangular apertures formed in the central coupling plate 103. The matched load 118 of the hybrid coupler 114 is realized in the second waveguide plate 101 and may be made of the same material as specified above. The corresponding signal propagation by means of the c-shaped connection between the portions 111*a* and 114 in the first waveguide plate 102 is indicated as a dashed arrow in the second quadrant of FIG. 1*b*. A further c-shaped transition connects the hybrid coupler 114 in the first waveguide plate 102 with a corresponding portion of the third hybrid coupler 112, wherein the c-shaped transition is again indicated in FIG. 1*b* as a dashed arrow connecting the couplers 114 and 112 in the second quadrant. Correspondingly, the other part of the hybrid coupler 112 is realized by the corresponding linear portion in the second waveguide plate 101 and the corresponding rectangular apertures in the central coupling plate 103. Moreover, the portion of the coupler 112 in the first waveguide plate 102 may connect to the corresponding output coupling portion 109*a* for providing the output signal C3. Formed on the same level on the left side of the waveguide section belonging to the hybrid coupler 112, is a waveguide section with one branch of the hybrid coupler 113 terminating in the output coupling portion 108*a* of the first waveguide plate 102, while the other branch of the hybrid coupler 113 terminates into the output coupling portion 108*b* of the second waveguide plate 101. The corresponding rectangular apertures in the central coupling plate 103 are again illustrated in FIG. 1*g*.

One level lower, on the right hand side of the first waveguide plate 102 is located a branch of the hybrid coupler 115 belonging to the fourth quadrant of FIG. 1*b*. Moreover, the matched load 117 extends substantially perpendicularly upwards in the first waveguide plate 102. Similarly, in the second waveguide plate 101 the corresponding branch of the coupler 115 is connected to the respective branch of the coupler 112 by a further c-shaped connection. The corresponding coupling apertures in the central coupling plate 103 are again shown in FIG. 1*g*. Directly connected to the hybrid coupler 115 in the first waveguide plate 102 is a waveguide section belonging to the phase shifter 116, which is designed so as to provide for a differential 90 degree phase shift.

The phase shifter is realized by a cascade of H-plane stubs in the form of rectangular apertures in the second waveguide plate 101, as indicated in FIG. 1*f*. Moreover, a corresponding pattern of coupling apertures is of course also provided in the central coupling plate 103, as shown in FIG. 1*g*. Finally, on the lowest level of the first waveguide plate 102 the corresponding branch of the directional coupler 111*b* is provided and terminates in the respective output coupling portion 107*a* while at the opposite end of this waveguide section the matched load 119*b* is provided. Similarly, in the second waveguide plate 101 the corresponding branch of the hybrid coupler 111*b* is directly connected to the waveguide filter 110*b*, which in turn is connected to the input coupling portion 106*b*. It should be appreciated that the waveguide sections formed within the first and the second waveguide plates 102 and 101 have identical configuration since all of the components are symmetrical with respect to the axis S shown in FIG. 1*f* so that the first waveguide plate 102 may be made to coincide with the second plate 101 by rotating the first or the second waveguide plate by 180 degree around the axis S. Hence, the first and second waveguide plates 102, 101 may be considered as being identical except for a 180 degree rotation.

For assembling the waveguide correlation unit 100 as shown in FIGS. 1*c*-1*e*, the first waveguide plate 102 as depicted in FIG. 1*f* may be subjected to a translation as indicated by the arrow T so that the various components as indicated in FIG. 1*f* coincide with the respective components in the second waveguide plate 101, wherein the central coupling plate 103 is disposed between the first and second waveguide plates 102, 101. It should be appreciated that by the substantially snake-like configuration of the various waveguide sections an extremely compact structure is obtained, wherein in the embodiments shown, the overall configuration may be considered as being provided on five different levels within the plane of each of the waveguide plates 102, 101. In other embodiments, a different geometrical configuration may be selected as long as the symmetry of the first and second waveguide plates 102, 101 is maintained. For example, a three level configuration may be provided, thereby reducing the height of the unit 100, while however significantly increasing its length.

Designing the first and second waveguide plates as identical components offers the potential for significantly reducing any mechanical uncertainties, since the first and second waveguide plates 102, 101 may be formed in a single common manufacturing process, during which a relative movement between the first and second waveguide plates 102, 101 may be avoided. Hence, during the fabrication of the first and second plates 102, 101 an appropriate conductive material having the required constant thickness for forming therein the rectangular waveguide components with appropriate dimensions for the specified wavelengths ranges may appropriately be positioned so as to allow the fabrication of the waveguide sections in the first and second plates 102, 101 in a single and common process. For example, two identical sheets of waveguide material may be stacked and fixed so as to avoid any mechanical movement and may then be processed by any appropriate tool, such as a wire electric discharge machine, and the like, thereby providing substantially identical waveguide sections simultaneously in the first and second waveguide plates 102, 101, wherein any deviations from a target or design dimension owing to machine and process fluctuations may occur substantially identically in both waveguide plates, thereby still maintaining the high degree of symmetry in the final unit 100. In other examples, the first and second waveguide plates 102, 101 may be formed from a single sheet of waveguide material when a corresponding cutting tool may have incorporated therein two mechanically coupled cutting heads that therefore move highly synchronously and simultaneously to thereby form substantially identical waveguide sections.

In one advantageous embodiment, a plurality of through-holes 120 is provided in the first and second waveguide plates 102, 101 and also in the central coupling plate 103 as well as in the respective cover plates 105, 104. The through-holes 120 may be provided for assembling the waveguide correlation unit 100 with high mechanical precision, since the total error during assembling the several plates of the waveguide correlation unit 100 is significantly reduced as the number of through-holes 120 is increased and a substantially uniform pressure is created after assembling the unit 100, thereby maintaining a high degree of metallic continuity. Moreover, in one preferred embodiment, the through-holes 120 in the first and second waveguide plates 102, 101, the central coupling plate 103 and the respective cover plates 104, 105 may be formed in a common manufacturing process, substantially without requiring any mechanical repositioning of one or more of the respective plates during the fabrication process. For example, after the formation of the various waveguide sections in the first and second waveguide plates 102, 101 in a common manufacturing process, in which both plates are fixedly positioned with respect to each other, an appropriate sheet of material for the central coupling plate 103 and for the cover plates 104, 105 may be stacked and fixed. Thereafter, the through-holes 120 may be formed in a single manufacturing process, thereby providing the through-holes 120 in a substantially identical fashion in each of the respective plates, achieving a high overlay accuracy for the various through-holes and also providing for an enhanced uniformity of the respective through-holes in each of the plates. Since the first and second waveguide plates 102, 101 have to be rotated by 180 degrees after the common manufacturing process so as to be stacked for assembling the waveguide correlation unit 100, the pattern of through-holes 120 is preferably formed as a symmetric pattern, wherein a symmetry axis 121 is defined such that it is parallel to the axis of rotation S. Consequently, although, for instance, a through-hole 120*a* of the second waveguide plate 101 may commonly be formed with a through-hole 120*b* in the first waveguide plate 102, and thus do not correspond in the final assembled state, nevertheless a high degree of mechanical precision is obtained, since it may be assumed that each manufacturing process for the various through-holes 120 is quite similar so that even after the 180 degree rotation corresponding through-holes 120*a* and 120*b* are substantially identical. Moreover, as previously explained, the high number of through-holes 120 provides a uniform contact between the various parts thereby significantly contributing to superior performance of the waveguide correlation unit 100.

In order to evaluate the operational behaviour and performance of the waveguide correlation unit 100, measurements of the scattering parameters of the waveguide correlation unit 100 have been performed so as to obtain the transfer functions, which in turn yield the Stokes parameters. If an ideal behaviour of the diodes 153 and of the differential amplifiers 151, 152 (cf FIG. 1*a*) is assumed, it is possible to define a spectral distribution of the Stokes parameters transfer functions, whose integration yields the relevant data. To this end, the following quantities may be considered:

$$C_k=|S_{ka}A+S_{kb}B|^2 \text{ with } k=1, 2, 3, 4$$

where, with reference to FIG. 1*b* $S_{ka}$ and $S_{kb}$ are the scattering parameters of the waveguide correlation unit.

By subtracting $C_1$ from $C_2$ and $C_4$ from $C_3$, one obtains:

$$Q_m=C_2-C_1=H_{qq}\Re\{AB^*\}+H_{qu}\Im\{AB^*\}+H_{qa}|A|^2+H_{qb}|B|^2$$

$$U_m=C_3-C_4=H_{uq}\Re\{AB^*\}+H_{uu}\Im\{AB^*\}+H_{ua}|A|^2+H_{ub}|B|^2$$

with $$H_{qq}=2\Re\{S_{2a}S_{2b}^*-S_{1a}S_{1b}^*\}$$

$$H_{qu}=-2\Im\{S_{2a}S_{2b}^*-S_{1a}S_{1b}^*\}$$

$$H_{uq}=2\Re\{S_{3a}S_{3b}^*-S_{4a}S_{4b}^*\}$$

$$H_{uu}=-2\Im\{S_{3a}S_{3b}^*-S_{4a}S_{4b}^*\}$$

$$H_{qa}=|S_{2a}|^2-|S_{1a}|^2$$

$$H_{qb}=|S_{2b}|^2-|S_{1b}|^2$$

$$H_{ua}=|S_{3a}|^2-|S_{4a}|^2$$

$$H_{ub}=|S_{3b}|^2-|S_{4b}|^2$$

Figure 1H:
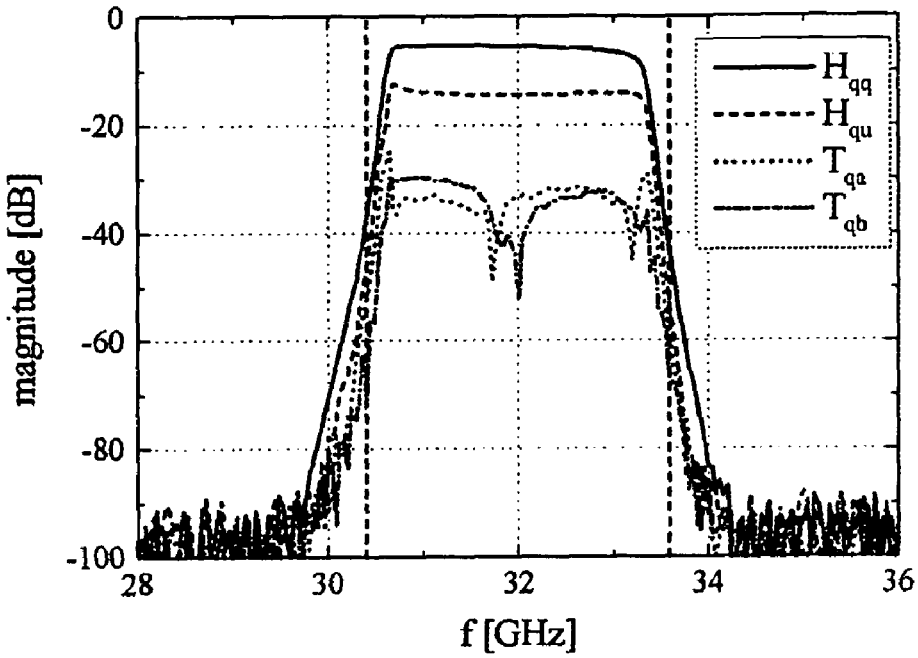
FIG. 1*h* shows the plots of the transfer functions corresponding to the evaluation of the Q and U Stokes parameters obtained by Kaband measurements of the waveguide correlation unit illustrated in the preceding figures.
Figure 1H:
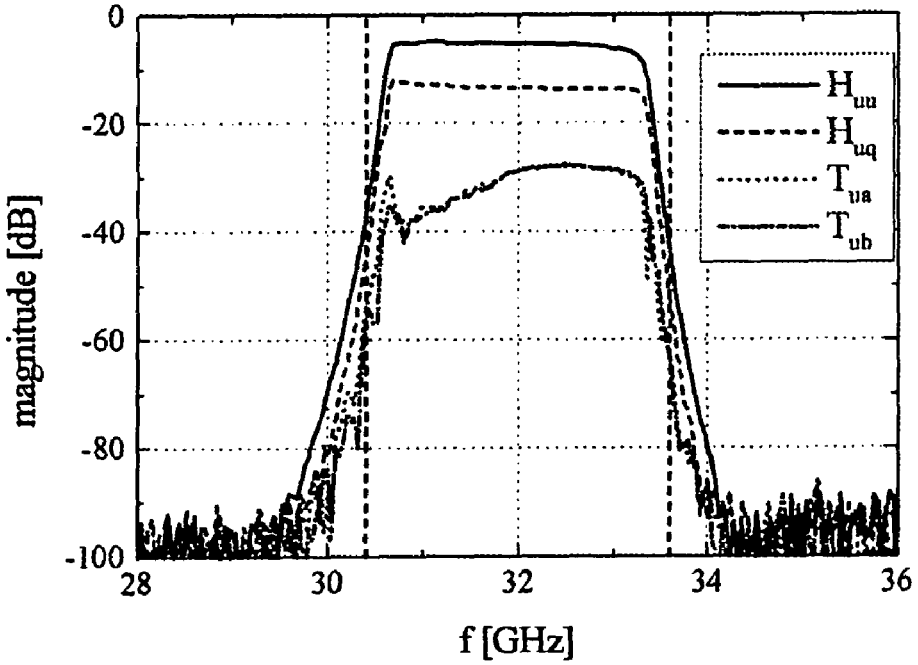

The eight transfer functions defined by the previous equations are obtained by the measured scattering parameters $S_{ka}$ and $S_{kb}$ with k=1, 2, 3, 4, FIG. 1*h* shows the eight transfer functions corresponding to the evaluation of the Q and U Stokes parameters, wherein all the transfer functions are obtained from the measurements of the waveguide correlation unit 100 designed for operating in the Ka wavelength band. As is evident from the graphs of FIG. 1*h*, the rejection for the auto correlation terms is approximately 30 dB. Moreover, by means of their integration, the detection error of the linearly polarized radiation is better than 0.17 dB for the amplitude and 1.14 degree, with an offset of 0.31 degree, for the direction.

Consequently, the waveguide correlation unit 100 provides a very high rejection of the auto correlation terms, which is achieved by imposing very severe specifications to the various waveguide components. In particular, the symmetrical configuration of the first and second waveguide plates 102, 101 enables a significant reduction of mechanical uncertainties for very short microwave wavelengths. Moreover, the various waveguide components are designed as rectangular waveguides formed in appropriate material sheets of constant thickness, wherein the dimensions of the internal waveguide sections are chosen so as to minimize the dispersion effects of the directional couplers within the corresponding operating bands. As previously explained, the symmetric configuration of the waveguide correlation unit 100 not only provides for a manufacturing process, in which any movements of the waveguide plates during the manufacturing sequence may be avoided, thereby substantially eliminating any positioning errors, but also within only minute mechanical uncertainties a higher level of symmetry is provided so as to obtain a high rejection for the non-polarized radiation.

Figure 2:
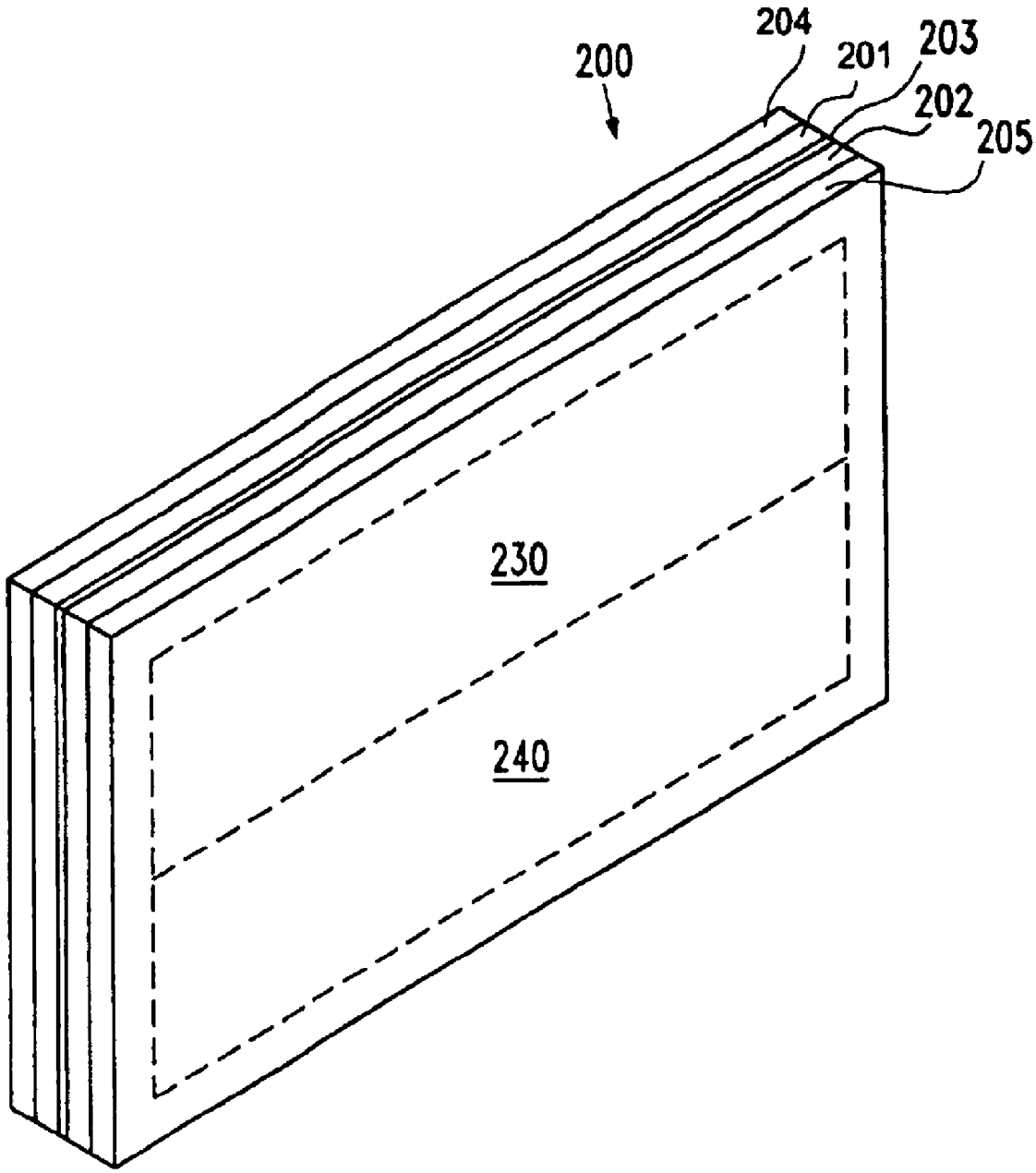
FIG. 2 schematically depicts a waveguide correlation device including a plurality of units similar to the units described with reference to FIGS. 1*a* to 1*h*.

FIG. 2 schematically shows a perspective view of a waveguide correlation device 200 comprising a first waveguide plate 202 and a second waveguide plate 201 with a central coupling plate 203 disposed therebetween. Moreover, a first cover plate 205 may be attached to the first waveguide plate 202 and a second cover plate 204 may be attached to the second waveguide plate 201. The device 200 may have formed within the first and second waveguide plates 202, 201 two or more waveguide correlation units, as are for instance shown and described with reference to FIGS. 1*a*-1*h*. For instance, a first portion of the device 200, indicated as 230, may be designed to operate substantially independently from a second portion, indicated as 240, while still a high degree of mechanical accuracy is obtained, since the portions 230 and 240 may be manufactured in a common manufacturing process, as is also described above with reference to the waveguide correlation unit 100. For example, the portions 230, 240 may be designed similarly to the unit 100 and so as to operate at different wavelength ranges, thereby providing the possibility for obtaining measurement data for different wavelength ranges of interest in a common measurement process. In other embodiments, the portions 230, 240 may operate substantially in the same frequency range, but may be connected to differently oriented antennas. Moreover, it should be appreciated that more than two individual waveguide portions 230, 240 may be provided on each of the corresponding waveguide plates 202, 201 so as to significantly enhance the measurement capabilities of the device 200, while still providing for a moderately compact arrangement.

Thus, the device comprises 200 may offer substantially the same advantages with respect to mechanical uncertainties as is explained with reference to the waveguide correlation unit 100, since the respective waveguide plates 202, 201 carrying a highly complex waveguide pattern may be fabricated substantially without any positioning errors, while the functionality of the device 200 may be adapted to the measurement requirements.

The invention claimed is:

1. A waveguide correlation unit comprising:

a first waveguide plate comprising a first input coupler for receiving a first signal (A) and a plurality of first output couplers;

a second waveguide plate comprising a second input coupler for receiving a second signal (B) and a plurality of second output couplers, said first and second waveguide plates having the same layout configuration;

a central coupling plate disposed between the first and the second waveguide plates so as to form a stacked structure with the first waveguide plate and the second waveguide plate, wherein said first and second waveguide plates comprise first and second waveguide filters, respectively, said first waveguide filter being coupled to said first input coupler and said second waveguide filter being coupled to said second input coupler.

2. The waveguide correlation unit of claim 1, further comprising a first directional coupler and a second directional coupler, wherein said first and second directional couplers are coupled to one of said second and first output couplers, respectively, and are configured to provide first and second monitor signals ($P_A$, $P_B$) for said first and second signals, respectively.

3. The waveguide correlation unit of claim 1, further comprising a first hybrid coupler configured to receive a portion of said first signal, a second hybrid coupler configured to receive a portion of said second signal, said first and second hybrid couplers providing a first and a second part of said portions of the first and second signals, respectively.

4. The waveguide correlation unit of claim 3, further comprising:

a third hybrid coupler configured to receive said first parts of said portions of the first and second signals;

a phase shifter configured to receive the second part of said portion of the second signal; and a fourth hybrid coupler configured to receive said phase-shifted second part and the non-phase shifted second part of said portion of the first signal.

5. The waveguide correlation unit of claim 1, wherein a spatial orientation in said stacked structure of said first waveguide plate is identical to a spatial orientation of said second waveguide plate except for a 180° rotation.

6. The waveguide correlation unit of claim 1, wherein each of a plurality of waveguide sections in said first and second waveguide plates comprises a rectangular cross-section.

7. The waveguide correlation unit of claim 6, wherein said waveguide sections are arranged in a plurality of levels within an E-plane defined by said first and second waveguide plates.

8. The waveguide correlation unit of claim 7, wherein said waveguide sections are arranged in five levels.

9. The waveguide correlation unit of claim 1, further comprising a first cover plate attached to said first waveguide and a second cover plate attached to said second waveguide plate, said first cover plate having formed thereon flanges connected to said first input coupler and said plurality of first output couplers, and said second cover plate having formed thereon flanges connected to said second input coupler and said plurality of second output couplers.

10. The waveguide correlation unit of claim 1, further comprising a plurality of through-holes extending at least through said first and second waveguide plates and said central coupling layer for fixing a relative position of the first and second waveguide plates and the central coupling layer with respect to each other.

11. The waveguide correlation unit of claim 10, wherein said plurality of through-holes are arranged in each of said first and second waveguide plates in a symmetric manner with respect to a symmetry axis defined in each of the first and second waveguide plates.

12. The waveguide correlation unit of claim 5, wherein said symmetry axis is parallel to an axis (S) of rotation of said 180° rotation.

13. The waveguide correlation unit of claim 1, wherein each of said waveguide filters is comprised of a cascade of E-plane discontinuities.

14. The waveguide correlation unit of claim 2, wherein each of the first and second directional couplers comprises a matched load integrally formed with said first and second waveguide plates.

15. The waveguide correlation unit of claim 3, wherein said first and second hybrid couplers each comprise a matched load integrally formed with said first and second waveguide plates.

16. The waveguide correlation unit of claim 1, configured to process said first and second signals having a single centre wavelength ranging from 1 to 15 mm.

17. A waveguide correlation device comprising:

a first waveguide correlation unit according to claim 1 configured to process a first centre wavelength;

a second waveguide correlation unit according to claim 1 configured to process a second centre wavelength;

wherein said first waveguide plates of the first and second waveguide correlation units are integrally formed in a first plate and wherein said second waveguide plates of the first and second waveguide correlation units are integrally formed in a second plate.

18. A method of manufacturing a first and second waveguide plate to be stacked so as to form a waveguide correlation unit, the method comprising:

designing an identical layout for a waveguide pattern of said waveguide correlation unit for each of the first and second waveguide plates;

fixedly positioning a first piece of waveguide material relative to a second piece of waveguide material;

simultaneously transferring said waveguide pattern into said first and second pieces to form said first and second waveguide plates;

aligning said first and second waveguide plates with respect to each other after releasing them from the fixed position so as to form a stack defining in combination the components of said waveguide correlation unit; and fixing said aligned stack.

19. The method of claim 18, further comprising forming a pattern of through-holes while transferring said waveguide pattern into said first and second pieces, wherein said pattern of through-holes is symmetric in each of the first and second waveguide plates with respect to a corresponding axis defined in each of the first and second waveguide plates.

20. The method of claim 19, further comprising fixedly positioning a central coupling plate for said waveguide correlation device with respect to said first and second waveguide plates and commonly forming said through-holes in said first and second waveguide plates and in said central coupling plate.

21. The method of claim 20, further comprising fixedly positioning first and second cover plates with respect to said first and second waveguide plates and commonly forming said through-holes in said first and second waveguide plates and said first and second cover plates.

* * * * *